US007550244B2

(12) United States Patent
Jin et al.

(10) Patent No.: US 7,550,244 B2
(45) Date of Patent: Jun. 23, 2009

(54) REACTIVE POLYMER PARTICLES AND METHOD OF PREPARATION

(75) Inventors: Xin Jin, Pittsford, NY (US); Lloyd A. Lobo, Rochester, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 340 days.

(21) Appl. No.: 11/453,177

(22) Filed: Jun. 14, 2006

(65) Prior Publication Data

US 2007/0292800 A1 Dec. 20, 2007

(51) Int. Cl.
*G03G 9/08* (2006.01)

(52) U.S. Cl. ..... 430/137.1; 430/124.4

(58) Field of Classification Search ..... 430/137.1, 430/124.4

See application file for complete search history.

(56) References Cited

U.S. PATENT DOCUMENTS

| | | | | |
|---|---|---|---|---|
| 4,833,060 | A | 5/1989 | Nair et al. | |
| 4,835,084 | A | 5/1989 | Nair et al. | |
| 4,965,131 | A | 10/1990 | Nair et al. | |
| 5,133,992 | A | 7/1992 | Nair et al. | |
| 5,470,683 | A | 11/1995 | Inaishi | |
| 5,905,012 | A * | 5/1999 | De Meutter et al. | 430/124.1 |
| 6,294,595 | B1 | 9/2001 | Tyagi et al. | |
| 6,416,921 | B1 | 7/2002 | Wilson et al. | |
| 6,482,562 | B2 | 11/2002 | Ezenyilimba et al. | |
| 6,535,711 | B2 | 3/2003 | Rohde et al. | |
| 6,608,987 | B2 | 8/2003 | Bartscher et al. | |
| 2005/0137278 | A1 * | 6/2005 | Fromm et al. | 522/100 |

FOREIGN PATENT DOCUMENTS

WO WO 2005/116778 12/2005

* cited by examiner

*Primary Examiner*—John L Goodrow
(74) *Attorney, Agent, or Firm*—Carl F. Ruoff; Andrew J. Anderson

(57) ABSTRACT

The present invention provides a method for the preparation of a UV curable electrostatographic toner. The process includes the steps of dispersing a polymeric material and a UV curable material and a UV photoinitiator in an organic solvent to form an organic phase. The organic phase is dispersed in an aqueous phase containing a particulate stabilizer to form a dispersion. The dispersion is homogenized and the organic solvent is removed from the dispersed particles in the dispersion which are then recovered.

14 Claims, No Drawings

REACTIVE POLYMER PARTICLES AND METHOD OF PREPARATION

FIELD OF THE INVENTION

The present invention is related to the preparation of radiation curable toner particles by chemical toner technology, particularly, by evaporative limited coalescence process. The radiation curable toners are preferably based on ultra-violet (UV) curable materials, containing unsaturated functional groups and photo initiators. A limited coalescence process and UV curable mixtures are provided for the toner particle preparation.

BACKGROUND OF THE INVENTION

In electrophotography or similar imaging process, a latent image is formed on a photoreceptor and then developed by charged toner particles. The developed toner image is transferred to a receptive substrate and fixed on the substrate by heat. However, there are many issues related to the physical properties of the fused image. For example, the toner image can become sticky and tacky during storage, depending on the environment conditions. When the image is tacky, it may transfer portions of the image to the other side of adjacent substrates or images so that the images are damaged. This phenomenon is called blocking in many references. During double-side printing the fused image on one-side need to go through the fusing device again and the image quality of oneside may be negatively impacted during the second heat. The toner image may also become sticky during second heat and block to substrate and fusing device. In addition, the toner image may be damaged by physical abrasion and wear during application.

Those problems can be solved through radiation curable toner approach. In this approach, the heat-fused toner image is further cured or crosslinked by radiation, e.g. UV light. The mechanical properties of the toner image, e.g. toughness and glass transition, are improved by crosslinking. The application of radiation curable toners has been suggested in several patents, e.g. U.S. Pat. No. 5,905,012, No. 6,608,987, No. 5,470,683 and No. 6,535,711.

In the conventional method of making electrophotographic toner powders, a binder polymer and other ingredients, such as a pigment and a charge control agent, are melt blended on a heated roll or in an extruder. The resulting solidified blend is then ground or pulverized to form a powder. The conventional grinding process has one significant drawback for the preparation of radiation curable toners. The radiation curable binders contain unsaturated functional groups, which are supposed to be crosslinked only upon radiation. However, the crosslinking reaction may also occur during melt blending or extrusion of the grinding process, when the materials are exposed to high temperature. This kind of side reaction not only destroys the functional groups for further radiation curing but also makes the toner materials tougher and more difficult for grinding. The crosslinking side-reaction also increases the glass transition temperature (Tg) of the radiation curable toner. Due to the side-reaction, it is difficult to control Tg of the final toner product, which impacts its fusing properties directly. In addition, uncontrolled crosslinking reaction creates inhomogeneity during melt blending or extrusion and the heterogeneous toner compounds result in a wide particle size distribution. Consequently, the yield of useful toner is lower and manufacturing cost is, therefore, higher. Also the toner fines accumulate in the developer station of the copying apparatus and adversely affect the developer life.

U.S. Pat. No. 5,470,683 prepares photosensitive microcapsule toners through emulsion polymerization. This kind of preparation process could minimize the crosslinking side-reaction because of its relatively low processing temperature and microcapsulation structures. However, the nature of the emulsions limits the toner binder variety and the manufacturing of the encapsulated toners is relatively complicated.

The present invention is related to the preparation of radiation curable toner particles by chemical toner technology, particularly, by evaporative limited coalescence process. In this process, toner particles are obtained by forming a solution of a polymer in a solvent that is immiscible with water, dispersing the solution so formed in an aqueous medium containing a solid colloidal stabilizer such as colloidal silica, and removing the solvent by evaporation. The resultant polymer particles are then isolated, washed and dried. During the evaporative limited coalescence process no heat or a limited amount of heat is used and the toner binders do not need to be exposed to any temperature significantly higher than room temperature. Those process conditions prevent the crosslinking side reaction of the unsaturated functional groups of the radiation curable materials.

The evaporative limited coalescence offers many other advantages over the conventional grinding method of producing toner particles. Toner particles can be prepared by the evaporative limited coalescence technique from any type of binder polymer that is soluble in a solvent that is immiscible with water. The size and size distribution of the resulting polymer particles can be controlled by the relative quantities of the polymer employed, the solvent, the quantity and size of the water-insoluble particulate suspension stabilizer and the size to which the solvent-polymer droplets are reduced by the agitation employed in dispersing the organic solution in the aqueous medium. Representative patents disclosing toner manufacture by limited coalescence and advantages thereof include U.S. Pat. Nos. 4,833,060, 4,835,084, 4,965,131, 5,133,992, 6,294,595 6,416,921 and 6,482,562, each of which is incorporated herein by reference.

SUMMARY OF THE INVENTION

The present invention provides a method for the preparation of a UV curable electrostatographic toner. The process includes the steps of dispersing a polymeric material and a UV curable material and a UV photoinitiator in an organic solvent to form an organic phase. The organic phase is dispersed in an aqueous phase containing a particulate stabilizer to form a dispersion. The dispersion is homogenized and the organic solvent is removed from the dispersed particles in the dispersion which are then recovered.

DETAILED DESCRIPTION OF THE INVENTION

In accordance with the present invention a dispersion of a polymeric, a UV curable material, a UV photoinitiator, a solvent and optionally a charge control agent and a pigment dispersion are combined to form an organic phase. This mixture is permitted to stir overnight and then dispersed in an aqueous phase comprising a particulate stabilizer and optionally a promoter.

The resultant mixture is then subjected to mixing and homogenization. The flocculating agent is added to the aqueous phase either before or after mixing/homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume may range from 1:1 to approximately 9:1. This indicates that the organic phase is typically present in an amount from about 10% to 50% of the total homogenized volume.

Following the homogenization treatment, the solvent present is removed by evaporation or boiling, optionally under vacuum, and the resultant product washed and dried.

The solvents chosen for use in the organic phase steps may be selected from among any of the well-known solvents capable of dissolving polymers. Typical of the solvents chosen for this purpose are chloromethane, dichloromethane, ethyl acetate, vinyl chloride, n-propyl acetate, iso-propyl acetate, trichloromethane, carbon tetrachloride, ethylene chloride, trichloroethane, toluene, xylene, cyclohexanone, 2-nitropropane, and the like.

The particulate stabilizer selected for use herein may be selected from among highly crosslinked polymeric latex materials of the type described in U.S. Pat. No. 4,965,131 to Nair et al., or silicon dioxide. Silicon dioxide is preferred. It is generally used in an amount ranging from 1 to 15 parts, by weight, based on 100 parts of the total solids in the toner. The size and concentration of these stabilizers control and predetermine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxyl methylcellulose, tetramethyl ammonium hydroxide or chloride, diethylaminoethylmethacrylate, water-soluble complex resinous amine condensation products of ethylene oxide, urea and formaldehyde and polyethyleneimine. Also effective for this purpose are gelatin, casein, albumin, gluten and the like or non-ionic materials such as methoxycellulose. The promoter is generally used in an amount from about 0.2 to about 0.6 parts per 100 parts of aqueous solution by weight.

Various additives generally present in electrostatographic toner may be added to the polymer prior to dissolution in the solvent or in the dissolution step itself, such as charge control agents, waxes and lubricants. Suitable charge control agents are disclosed, for example, in U.S. Pat. Nos. 3,893,935 and 4,323,634 to Jadwin et al., U.S. Pat. No. 4,079,014 to Burness et al. and British Patent No. 1,420,839 to Eastman Kodak. Charge control agents are generally employed in small quantities such as from about 0 to 10 parts per hundred based upon the weight of the total solids content (weight of the toner) and preferably from about 0.2 to about 3.0 parts per hundred.

The present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins; polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers such as butyl acrylate-styrene copolymer, cellulose derivatives, polyesters, polyvinyl resins and ethylene-vinyl alcohol copolymers and the like. Preferably, the polymer material is polyester or butyl acrylate-styrene copolymer. Optionally, the polymer material also may contain UV curable functional groups, such as ethylenic unsaturated groups or epoxide groups, to be polymerized upon exposure to a UV radiation source.

The UV curable toner embodiment of the invention comprise UV curable components containing mono-, di-, or polyfunctional ethylenic unsaturated groups or multi-functional epoxide groups. The UV curable components may be in liquid or solid forms. Examples of ethylenic unsaturated compounds include styrenic derivatives, vinyl ether, vinyl ester, allyl ether, allyl ester, N-vinyl caprolactam, N-vinyl caprolacton, acrylate, or methacrylate monomers. The examples of such compounds may also include oligomers of epoxy acrylates, urethane acryaltes, unsaturated polyesters, polyester acrylates, polyether acrylates, vinyl acrylates and polyene/thiol systems. The most commonly used UV curable components contain the acrylate unsaturation groups. The backbone structures of acrylate compounds include aliphatic, cycloaliphatic, aromatic, alkosylated, polyols, polyester, polyether, silicone, and polyurethane. The UV curable ethylenic unsaturated components may be polymerized via free radical polymerization initiated by a photoinitiator upon exposure to radiation source, e.g. UV radiation. The ethylenic unsaturated groups are consumed during the polymerization process and the degree of unsaturated groups conversion is a measure of the degree of cure. The multi-functional epoxide compounds can be polymerized via cationic polymerization initiated by a photogenerated active species upon exposure to radiation source, e.g. UV radiation. However, cationic UV curing is not restricted to epoxide. The radiation-curable components typically have a weight average molecular weight ranging from 100 to 10,000, and preferably in a range from 400 to 4,000. The degree of unsaturation or epoxy group ranges from 2 to 30% by weight. Depending on specific application and final cured image properties, the weight ratio of UV curable components to non-reactive polymer binders in toner formulations may range from 0.1 to 100 percent.

One embodiment of the invention comprises a photoinitiator and/or a co-initiator that is chosen from those commonly used for radiation curing purposes. The appropriate photoinitiators which can be used in the present invention are direct cleavage (Norrish Type I or II) photoinitiators including benzoin and its derivatives, benzil ketals and its derivatives, acetophenone and its derivatives, hydrogen abstraction photoinitiators including benzophenone and its alkylated or halogenated derivatives, anthraquinone and its derivatives, thioxanthone and its derivatives, and Michler's ketone. Examples of photoinitators which may be suitable for the present invention are benxophenone, chlorobenzophenone, 4-benzoyl-4'-methyldiphenyl sulphide, acrylated bensophenone, 4-phenyl benzophenone, 2-chlorothioxanthone, isopropyl thioxanthone, 2,4-dimethyl thioxanthone, 2,4 dichlorothioxantlhone, 3,3'-dimthyl-4-methoxybenzophenone, 2,4-diethylthixanthone, 2,2-diethoxyacetophenone, a,a-dichloroaceto,p-phenoxyphenone, 1-hydroxycyclohexyl actecophenone, a,a-dimethyl,a-hydroxy acetophenone, benzion, benzoin ethers, benzyl ketals, 4,4'-dimethyl amino-benzophenone, 1-phenyl-1,2-propane dione-2 (O-ethoxy carbonyl) oxime, acylphosphine oxide, 9,10-phenantrene quinine, and the like. It may optionally be beneficial to use photosensitizers in combination with a radical generating initiator, wherein the sensitizer absorbs light energy and transfers it to the initiator. Examples of photsensitizers include thioxanthone derivatives and tertiary amines, such as tirethanolamine, methyl diethanolamine, ethyl 4-dimethyl aminobenzoate, 2(n-butoxy)ethyl 4-dimethylamino benzoate, 2-ethyl hexyl p-dimethyl-aminobenzoate, amyl p-dimethyl-aminobenzoate and tri-isopropanolamine. Photoinitiated cationic polymerization uses salts of complex organic molecules to initiate cationic chain polymerization in oligomers or monomers containing epoxides. Cationic photoinitiators include, but are not limited to diaryliodonium and triarylsulfonium salts with non-nucleophilic complex metal halide anions. Examples of cationic photoinitiators are aryldiazonium salts of the general formula $Ar—N_2^+X^-$, wherein Ar is an aromatic ring such as butyl benzene, nitrobenzene, dinitrobenzene, or the like and X is $BF_4$, $PF_6$, $AsF_6$, $SbF_6$, $CF_3SO_3$, or the like; diaryliodonium salts of the general formula $Ar_2\ I^+X^-$, wherein Ar is an aromatic ring such as methoxy benzene, butyl benzene, butoxy benzene, octyl benzene, didecyl benzene, or the like, and X is an ion of low nucleophilicity, such as $BF_4$, $PF_6$, $AsF_6$, $SbF_6$, $CF_3SO_3$, and the like; triarylsulfonium salts of the general formula $Ar_3\ S^+X_-$, wherein Ar is an aromatic ring such as hydroxy benzene, methoxy benzene, butyl benzene, butoxy benzene, octyl benzene, dodecyl benzene, or the like and X is an ion of low nucleophilicity, such as $BF_4$, $PF_6$, $AsF_6$, $SbF_6$, $CF_3SO_3$, or the like. The toner compositions may contain 0.1-20% by weight of photoinitiators, and preferably contain 1 to 10% by weight. UV curing technology via radical polymerization and cationic polymerization are well known. The UV curing materials and processes are reviewed in, for example, "*UV & EB Curing Technology & Equipment Volume I*" by R. Mehnert, A. Pincus, I. Janorsky, R. Stowe and A. Berejka, disclosure of which is totally incorporated herein by reference.

Optionally, pigments can be dispersed in the polymer, insoluble in water and yield strong permanent color. Typical of such pigments are the organic pigments such as phthalocyanines, lithols and the like and inorganic pigments such as $TiO_2$, carbon black, and the like. Typical of the phthalocyanine pigments are copper phthalocyanine, a mono-chloro copper phthalocyanine, and hexadecachloro copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red. The carbon black may be any of the known types such as channel black, furnace black, acetylene black, thermal black, lamp black, and aniline black. The pigments are employed in an amount sufficient to give a content thereof in the toner from about 1% to 40%, by weight, based upon the weight of the toner, and preferably within the range of 4% to 20%, by weight.

Flocculating agents are listed in detail in the book "The Chemistry of Silica" by R. K. Iler (John Wiley & Sons, 1979, pp. 384-396). Preferred flocculating agents suitable for use in the present invention include cationic surfactants, basic metal salts, cationic polymers and inorganic colloids. The flocculating agent may comprise 0.0001-50% by weight of the total solids present in the organic phase.

Preferred inorganic colloids are colloidal alumina and any colloidal silica with opposite charge of colloidal silica used as a stabilizer in the present invention such as positively charged LUDOX CL® silica or negatively charged NALCOAG 1060® silica.

A spherical particle is well known and is defined as a three dimensional object which has all points on the surface essentially equidistant from a central point. A non-spherical particle is defined as a three dimensional object in which individual points on the surface have varying distances from a central point. This will be seen as irregular, or oblong, or wrinkled shapes and surfaces. The toner particles prepared by the present invention have a particle size of from 3 to 20 microns, preferably 4 to 12 microns.

The invention will be more fully understood by reference to the following exemplary embodiment, which is set forth solely for purposes of exposition and is not to be construed as limiting. Unless otherwise indicated all percentages are by weight.

EXAMPLES OF THE INVENTION

The invention is demonstrated by the following examples.

Example 1

An aqueous mixture was prepared by mixing about 240 ml of distilled water, 10 grams of Nalcoag™1060 (50% solid), which is a sodium stabilized silica suspension by the Nalco Chemical Company, 2.2 ml of a 10 percent solution of poly (adipic acid-co-methylaminoethanol) and 1.5 grams of potassium phthalate. An organic solution was made by mixing 100 grams of ethyl acetate, 30 grams of a 70% solution of phenoxy modified epoxy diacrylate resin in ethyl acetate, which is called UV-93 from InChem Corporation, 2 grams of CN 968 and 2 grams of SR1130, both from Sartomer Company. The organic solution and aqueous phase were then mixed together and sheared by using a Silverson mixer followed by a Microfluidizer unit sold from Microfluidics operating at 275 kPa. The white emulsion was then heated to 40° C. under vacuum for about 30 minutes, during which the organic solvent, ethyl acetate evaporated from the mixture and the organic emulsion then became solid particles. The solid particles were washed with water and then stirred for 3 hours in a 1.0N sodium hydroxide solution to remove the silica particles from their surfaces. The particles were then filtered, washed with water and dried in a vacuum oven at 40° C. overnight. The collected toner particles are spherical with number average diameter of 6.8 micron and volume average diameter of 7.4 micron.

The toner particles of Example 1 were developed through electrophotographic process and applied on the surface of substrates, and then fused through fusing rollers at about 130° C. The fused images were cured under microwave-powered UV lamp from Fusion UV Systems, Inc. The energy of the UV curing is set to be about 250 mJ/cm$^2$ from H-type UV lamp and belt speed around 60 f/m. The organic solvent resistance, e.g. ethyl acetate, acetone, of the UV cured images is significantly better than the non-cured images based on the same Example 1 toner.

The UV cured images were put into a 65° C. and 95% RH environmental control oven. The image remained in the oven overnight with face-to-face contact to another image and predetermined pressure equal to 500 sheets of stacked paper. The UV cured images showed no sign of change or block problem after they are removed from the oven. In comparison, the non-UV cured images from Example 1 were fused together and surface images were totally damaged.

Example 2

The procedure of Example 1 was repeated except that the organic phase was prepared from 100 grams of ethyl acetate, 18.4 grams of P3125 and 4.6 grams of P3307, both from DSM, in addition to 2 grams of CN 968 and 2 grams of SR1130, both from Sartomer Company. The obtained toner particles from the evaporative limited coalescence process are spherical with number average diameter of 6.0 micron and volume average diameter of 8.2 micron.

The toner particles of Example 2 were developed through electrophotographic process and applied on the surface of substrates, and then fused through fusing rollers at about 130° C. The fused images were cured at about 250 mJ/cm$^2$ with H-type UV lamp and belt speed around 60 f/m. The organic solvent resistance, e.g. ethyl acetate, acetone, of the UV cured images is significantly better than the non-cured images based on the same Example 2 toner. The UV cured images were put into a 65° C. and 95% RH environmental control oven. The image remained in the oven overnight with face-to-face contact to another image and predetermined pressure equal to 500 sheets of stacked paper. The UV cured images showed no sign of change or block problem after they are removed from the oven. In comparison, the non-UV cured images from Example 2 were fused together and surface images were totally damaged.

Example 3

The procedure of Example 1 was repeated except that the organic phase was prepared from 100 grams of ethyl acetate, 24 grams of FPESL-2, low molecular weight polyester from Kao Corporation, 0.1 grams of CN968 from Sartomer Company, 0.05 grams of Bontron E84 from Orient Chemicals Company, 1 gram of ESACURE ONE from Sartomer. After ethyl acetate was removed from the white emulsion, the toner particles were washed with water and enough 1N sodium hydroxide solution was added dropwise to raise the pH of white suspension to 12. After stirred for 1 minute, the particles were then filtered, washed with water and dried in a vacuum oven at 40° C. overnight. The collected toner particles are spherical with number average diameter of 7.4 micron and volume average diameter of 7.9 micron.

The toner particles of Example 3 were developed through electrophotographic process and applied on the surface of substrates, and then fused through fusing rollers at about 130° C. The fused images were cured at about 250 mJ/cm$^2$ with H-type UV lamp and belt speed around 60 f/m. The organic solvent resistance, e.g. ethyl acetate, acetone, of the UV cured images is significantly better than the non-cured images based on the same Example 2 toner. The UV cured images were put into a 60° C. and 95% RH environmental control oven. The image remained in the oven overnight with face-to-face contact to another image and predetermined pressure equal to 500 sheets of stacked paper. The UV cured images showed no sign of change or block problem after they are removed from the oven. In comparison, the images from Example 3 but without UV curing were fused together and surface images were totally damaged.

Example 4

The procedure of Example 1 was repeated except that the organic phase was prepared from 110 grams of ethyl acetate, 24 grams of Pro7403 and 0.1 grams of CN968 from Sartomer, 0.36 grams of diphenyl sulfone from Sigma-Aldrich and 1 gram of Irgacure 184 from Ciba Specialty Chemicals. The organic solution and aqueous phase were then mixed together and sheared by using a Silverson mixer followed by a Microfluidizer unit sold from Microfluidics operating at 275 kPa. While homogenized by microfluidizer, the obtained emulsion was simultaneously added 4 g of 1% aqueous solution of poly((adipic acid-co-(methylaminoethanol)$_{90}$-co-(N-methyl-N-benzyl-diethanolammonium chloride)$_{10}$) dropwise. The white emulsion was then heated to 40° C. under vacuum for about 30 minutes, during which the organic solvent, ethyl acetate evaporated from the mixture and the organic emulsion then became solid particles. The toner particles were washed with water and enough 1N sodium hydroxide solution was added dropwise to raise the pH of white suspension to 12. After stirred for 1 minute, the particles were then filtered, washed with water and dried in a vacuum oven at 40° C. overnight. The collected toner particles are irregular and potato-like with number average diameter of 6.9 micron and volume average diameter of 8.7 micron.

The toner particles of Example 4 were developed through electrophotographic process and applied on the surface of substrates, and then fused through fusing rollers at about 130° C. The fused images were cured at about 250 mJ/cm$^2$ with H-type UV lamp and belt speed around 60 f/m. The organic solvent resistance, e.g. ethyl acetate, acetone, of the UV cured images is significantly better than the non-cured images based on the same Example 2 toner. The UV cured images were put into a 60° C. and 95% RH environmental control oven. The image remained in the oven overnight with face-to-face contact to another image and predetermined pressure equal to 500 sheets of stacked paper. The UV cured images showed no sign of change or block problem after they are removed from the oven. In comparison, the non-UV cured images from Example 4 were fused together and surface images were totally damaged.

Comparative Example 1

The procedure and formulation of Example 3 was repeated except that no photoinitiator, ESACURE ONE from Sartomer, was added to the organic phase. The collected toner particles are spherical with number average diameter of 7.2 micron and volume average diameter of 8.7 micron.

The toner particles of Comparative Example 1 were developed through electrophotographic process and applied on the surface of substrates, and then fused through fusing rollers at about 130° C. The fused images were cured at about 250 mJ/cm$^2$ with H-type UV lamp and belt speed around 60 f/m. The UV cured images were put into a 60° C. and 95% RH environmental control oven. The image remained in the oven overnight with face-to-face contact to another image and predetermined pressure equal to 500 sheets of stacked paper. However, due to lack of photoinitiator in the toner formulation, the cured images were fused together and showed no difference from those images without UV curing.

The invention has been described in detail with particular reference to certain preferred embodiments thereof, but it will be understood that variations and modifications can be effected within the spirit and scope of the invention.

The invention claimed is:

1. A method for the preparation of a UV curable electrostatographic toner comprising the steps of:

A) dispersing a polymeric material and a UV curable material and a UV photoinitiator in an organic solvent to form an organic phase;

B) dispersing the organic phase in an aqueous phase comprising a particulate stabilizer to form a dispersion and homogenizing the resultant dispersion; and C) removing the organic solvent from the dispersed particles formed in step (B) and recovering resultant product; wherein no more than a limited amount of heat is used which prevents crosslinking side reactions of the UV curable material.

2. The method of claim 1 wherein the polymeric material comprises at least one of the group consisting of polyurethanes, olefin homopolymers and copolymers, polytrifluoroolefins, polytetrafluoroethylene, polytrifluorochloroethylene, polyamides, acrylic resins, polystyrene, copolymers of styrene, cellulose derivatives, polyesters, polyvinyl resins, and ethylene-vinyl alcohol copolymers.

3. The method of claim 2 wherein the polymeric material further comprises charge control agents, pigments, waxes, or lubricants.

4. The method of claim 2 wherein the polymeric material contains unsaturated groups.

5. The method of claim 1 wherein the UV curable material comprises components containing mono-, di-, or polyfunctional ethylenic unsaturated groups or multi-functional epoxide groups.

6. The method of claim 1 wherein the UV initiator is selected from the group consisting of benzoin, benzoin derivatives, benzil ketals, benzil ketal derivatives, acetophenone, acetophenone derivatives, benzophenone, alkylated or halogenated benzophenone derivatives, anthraquinone, anthraquinone derivatives, thioxanthone, thioxanthone derivatives, and Michler's ketone.

7. The method of claim 1 wherein the particulate stabilizer comprises negatively or positively charged colloidal silica.

8. The method of claim 1 wherein the organic solvent is selected from the group consisting of chloromethane, dichloromethane, ethyl acetate, vinyl chloride, n-propyl acetate, iso-propyl acetate, trichloromethane, carbon tetrachloride, ethylene chloride, trichloroethane, toluene, xylene, cyclohexanone, and 2-nitropropane.

9. The method of claim 1 further comprising washing the resultant product.

10. The method of claim 1 wherein the aqueous phase further comprises a promoter selected from the group consisting of sulfonated polystyrenes, alginates, carboxyl methylcellulose, tetramethyl ammonium hydroxide, ammonium chloride, diethylaminoethylmethacrylate, water-soluble complex resinous amine condensation products of ethylene oxide, urea, formaldehyde, polyethyleneimine, gelatin, casein, albumin, gluten, and non-ionic materials.

11. The method of claim 10 wherein the promoter is an amount from about 0.2 to about 0.6 parts per 100 parts of aqueous solution by weight.

12. The method of claim 1 wherein the resultant product comprises polymeric particles having a particle size of from 3 to 20 microns.

13. The method of claim 1 wherein the polymeric material comprises a non-reactive polymer binder.

14. The method of claim 13 wherein the polymeric material comprises at least one of the group consisting of polyurethanes, olefin homopolymers and copolymers, polytrifluoroolefins, polytetrafluoroethylene, polytrifluorochloroethylene, polyamides, acrylic resins, polystyrene, copolymers of styrene, cellulose derivatives, polyesters, polyvinyl resins, and ethylene-vinyl alcohol copolymers.

* * * * *